US005087127A

United States Patent [19]

Knelson

[11] Patent Number: 5,087,127

[45] Date of Patent: Feb. 11, 1992

[54] REMOVAL OF CONCENTRATE FROM A CENTRIFUGAL SEPARATOR

[76] Inventor: Benjamin Knelson, 20313-8th Avenue, R.R. #1, Langley, British Columbia, Canada, V3A 6Y3

[21] Appl. No.: 547,078

[22] Filed: Jul. 5, 1990

[51] Int. Cl.[5] ..... B04B 11/00

[52] U.S. Cl. ..... 366/27; 366/29; 366/37; 366/80; 366/58

[58] Field of Search ..... 494/27, 37, 56, 57, 494/58, 59; 403/107; 15/401, 402

[56] References Cited

U.S. PATENT DOCUMENTS

| | | | |
|---|---|---|---|
| 1,119,176 | 12/1914 | Köpke | 494/56 |
| 1,848,476 | 3/1932 | Hall | 403/107 |
| 2,113,160 | 4/1938 | Murphee et al. | 494/59 |
| 2,894,634 | 7/1959 | Lepoutre et al. | 494/58 |
| 3,335,735 | 8/1967 | Colegrove et al. | 403/107 |
| 3,371,059 | 2/1968 | Rich | 494/59 |
| 4,608,040 | 8/1986 | Knelson | 494/29 |
| 4,615,690 | 10/1986 | Ecker | 494/57 |
| 4,631,048 | 12/1986 | Titrus | 494/56 |
| 4,652,254 | 3/1987 | Matsumoto | 494/58 |
| 4,676,770 | 6/1987 | Ostermeyer et al. | 494/59 |

*Primary Examiner*—Philip R. Coe
*Assistant Examiner*—Reginald L. Alexander
*Attorney, Agent, or Firm*—Adrian D. Battison; Stanley G. Ade; Murray E. Thrift

[57] ABSTRACT

A centrifugal bowl is intermittently cleaned of concentrate by a scoop which projects into the bowl and is indexed in a direction axially of the bowl and moved radially of the bowl to enter each in turn of a plurality of annular grooves formed on the bowl surface. The fluidized material in the groove enters the scoop and is extracted from the scoop by suction.

4 Claims, 2 Drawing Sheets

REMOVAL OF CONCENTRATE FROM A CENTRIFUGAL SEPARATOR

BACKGROUND OF THE INVENTION

This invention relates to a centrifugal separator of a type which can be used to extract heavy material such as gold from a slurry containing the metals mixed with other materials.

The issued U.S. Pat. Nos. 4,608,040 and 4,846,781 of the present applicant disclose a device of this type which comprises a centrifuge bowl having a base in a peripheral wall surrounding an axis passing through the base and generally upstanding from the base to an open mouth, a plurality of axially spaced inwardly projecting rings mounted on the inner surface of the peripheral wall and a plurality of openings extending through the peripheral wall from the outer surface to the inner surface thereof, the openings being arranged between each ring and the next adjacent ring and spaced around the peripheral wall, means for mounting the bowl for rotation about the axis, means for feeding the material into the bowl so that during rotation of the bowl the materials flow over the peripheral wall and discarded materials discharge from the open mouth while collected materials remain in the recesses between the rings as a concentrate, the materials between the rings being fluidized to cause a separation effect in the materials to preferentially collect the heavy metals.

This device has been found to operate very satisfactorily and in a considerably improved manner relative to prior devices such as those shown in the older Canadian Patent No. 111809 and in old Australian Patents Nos. 22055/35 and 17487/34 (MACNICOL).

However, all of these devices are batch devices in that the bowl is rotated for a period of time until a pre-determined quantity of material has passed through the bowl after which the separation efficiency can deteriorate due to the fact that the recesses have a large proportion of the heavy metals already separated so that further heavy metal can fail to properly separate and can be discarded. At this time it is necessary to stop the process including halting the bowl and the flow of feed materials and water into the bowl following which the bowl must be cleaned out and the concentrate collected. This shut down of the machine is of course highly undesirable in that it interfers with the otherwise continuous processing of the feed material, in that the clean out requires a relatively high level of manual activity and in that the shut down of the machines increases the number of machines which are required to process a certain quantity of materials.

It has been therefore an objective of many people in this field to provide a machine which will operate continuously without necessity for regular shut down for collection of the concentrate. Up until now, however, no machine of this general type is available for continuous operation despite the obvious requirement for a continuous operating machine of this type.

It is one object of the present invention, therefore, to provide a centrifugal separating machine of the general type described above which can operate continuously without the necessity for periodic shutdown of the machine for the cleaning operation.

According to the first aspect of the invention, therefore, there is provided apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, means for mounting the bowl for rotation about the axis, means for feeding materials into the bowl such that during rotation of the bowl the materials flow over the peripheral wall for discharge of discarded materials from the open mouth and for collection of a concentrate in the recesses, and means for removing the concentrate from each of the recesses comprising duct means, means for mounting the duct means so as to project into the bowl, a probe portion on the duct means for projecting into a respective one of the recesses, mouth means on the probe portion such that the material is the recess is caused to flow into the mouth means and means for moving the duct means from a first position in which the probe portion is inserted into the recess to a second position in which the probe portion is removed from the recess.

According to the second aspect of the invention, there is provided a method of centrifugally separating intermixed materials of different specific gravities comprising providing a centrifuge bowl having a base in a peripheral wall surrounding an axis passing through the base and generally upstanding from the base to an open mouth, the bowl having axially spaced inwardly projecting peripherally extending members defined on an inner surface of the peripheral wall so as to provide a peripherally extending recess between each member and the next adjacent member, rotating the bowl about the axis, feeding materials into the bowl such that during rotation of the bowl the materials flow over the peripheral wall with discarded materials discharging from the open mouth and retained material being collected on the peripheral wall within each of the recesses as a concentrate, temporarily inserting into each recess a probe portion of a duct member so as to cause material within the recess to flow into a mouth of the probe portion, and withdrawing the material from the duct member into a separate storage container.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
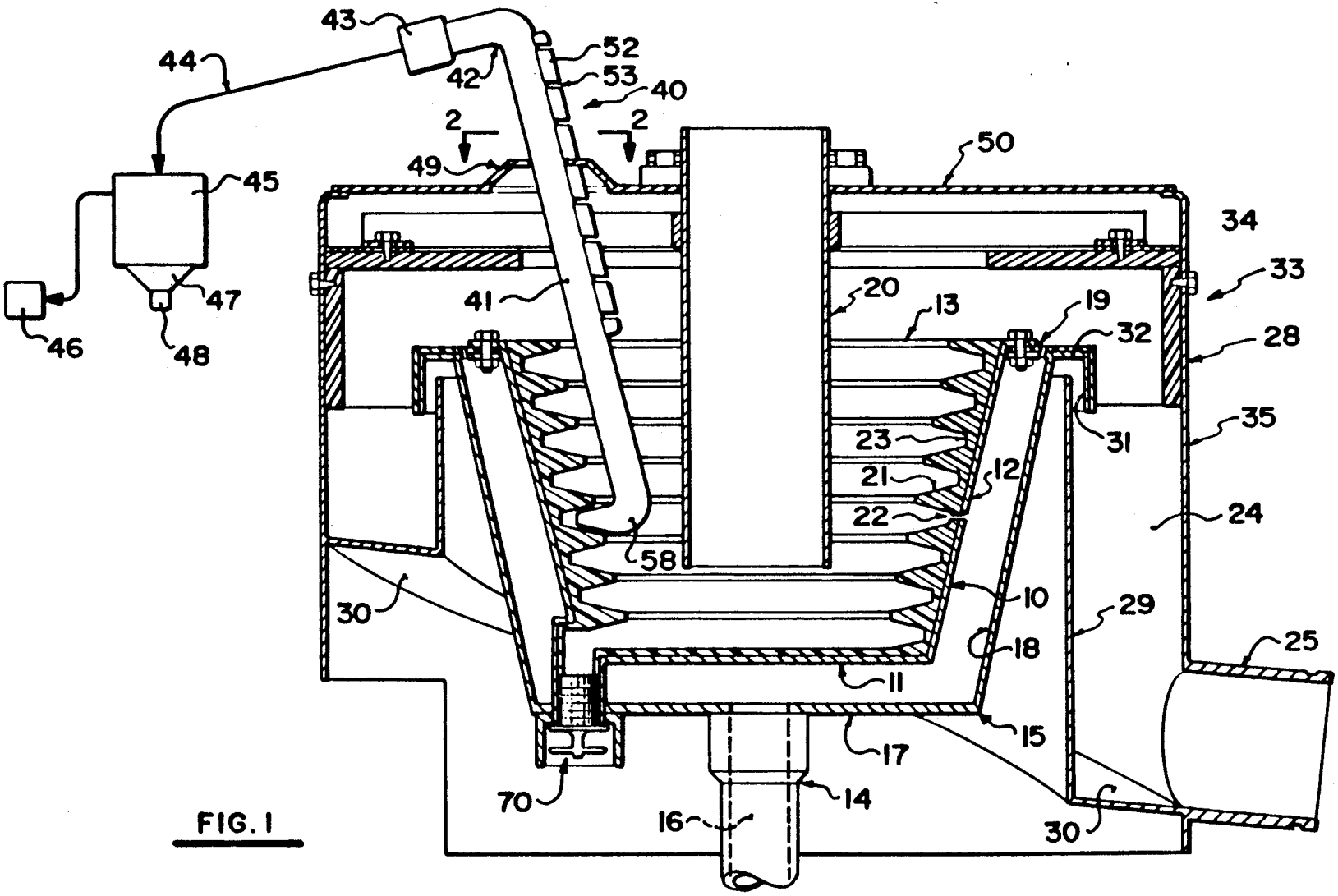
FIG. 1 is vertical cross sectional view of a bowl, outer casing and discharge device of a centrifugal separation device according to the present invention.

Turning firstly to FIG. 1, the basic construction of this arrangement is described in detail in U.S. Pat. No. 4,608,040 issued Aug. 26, 1986 to which reference should be made for any detail of the device omitted from this description. For convenience of the reader, some of the important figures will be described here.

Thus the apparatus is generally comprised of bowl 10 which has a base 11, a peripheral wall 12 and an open upper mouth 13. The bowl is mounted upon a shaft 14 for rotating about its axis and is surrounded by an outer casing 15 defining a jacket or enclosure around the bowl to which liquid may be supplied by a duct 16 to the shaft 14. The jacket includes a base 17 and peripheral wall 18 and a cover portion 19.

These materials can be deposited into the bowl through a supply duct 20 depending downwardly through the open mouth. On the inner surface of the peripheral wall of the bowl is provided a plurality of inwardly projecting rings 21 which define annular channels or recesses between the rings in which a fluidized bed is defined by a plurality of fluid inlet openings 22 which allow material to enter from the jacket 15 into the bowl through the base 23 of each of the channels. This defines a fluidized bed within the channels between the rings 21 which acts to separate heavier materials which collect in the channels from lighter materials which tend to flow out of the mouth of the bowl with the fluid into an outlet duct 24, 25.

The bowl 10 is mounted in a housing 28 which defines an outer surface for the channel 24. An inner circumferential wall 29 inside the housing 28 forms the channel 24 as an annular channel surrounding the bowl.

To assist in communication of the discharged material from the mouth of the bowl to the discharge duct 25, an inclined surface 30 is arranged around the bowl defining a lower surface of annular channel 24. A flange 31 carried around the periphery of the outer bowl 15 on a radial support surface 32 cooperates with the annular wall 29 to prevent material entering the area between the bowl 15 and confining the material to enter the channel 24. A guide surface 33 formed by an upper surface 34 and a peripheral surface 35 of the housing 28 act to change the direction of the material as it exits from the bowl so that it can properly enter the channel 24.

The bowl is driven in rotation by a pulley (not shown) on the shaft 14 which is in turn rotated by a drive motor (also not shown).

The above general description of the centrifugal separator constitutes prior art to present application as it is shown in the above U.S. patents. In operation of the device above described, the feed materials through the duct 20 flow over the peripheral wall causing the heavy metal to be collected within the recesses so that after a period of time of operation the collected materials constitutes a large majority of the material within the recesses so that further separation can not efficiently occur. At this point it is conventionally necessary to halt operation of the machine and to wash out the collected concentrate before the machine can be restarted and a further process batch carried out.

According to the present invention, there is provided a device for removing the collected materials while the process continues, that is the bowl continues to rotate and the feed materials are continually supplied through the feed duct 20.

The apparatus according to the present invention is therefore generally indicated at 40 and comprises a discharge duct 41 in the form of an elongated straight pipe which can in one example be of the order of 2 inches in diameter. The pipe is substantially rigid and of a construction in which prevents it from being damaged by the flowing materials.

At an upper end the pipe there is provided a right angle bend 42 and a valve 43 operable to open and close flow through the duct 41. A further hose connection schematically indicated at 44 extends from the upstream side of the valve 43 to a containing tank 45 with a suitable inlet coupled to hose 44 (not shown).

The tank 45 is connected to a vacuum pump 46 so that the tank 45 can be evacuated down to a maximum level of vacuum which can be generated by the pump 46. Normally with the valve 43 closed, the vacuum is maintained in the tank 45 and in the hose 44 at the maximum vacuum value. The tank 45 has a hopper bottom 47 connected to a valve 48 so the materials collected in the tank can be discharged into a separate tank for storage or directly into a further separating process from which the heavy metals can be further concentrated or extracted from the materials collected within the tank 45.

In one example of the device, the vacuum section including the hose 44 can be a moveable arrangement which can be transferred from one machine to the next and operate to remove the material from each machine in turn for collection within the tank 45. The tank can then be transferred to the gold room under security including a suitable locking arrangement with the tank then acting as a supply to the further separation device directly or simply for dumping of the contents into a container within the gold room where the final separation will take place. A quick release coupling (not shown) can thus be provided on the upstream side of the valve 43 and on the outer end of the hose 44.

Figure 2:
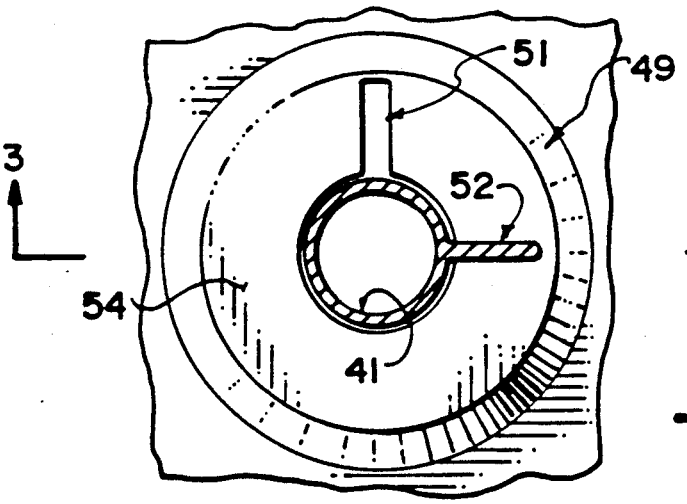
FIG. 2 is a cross sectional view along the lines of 2—2 of FIG. 1.
Figure 3:
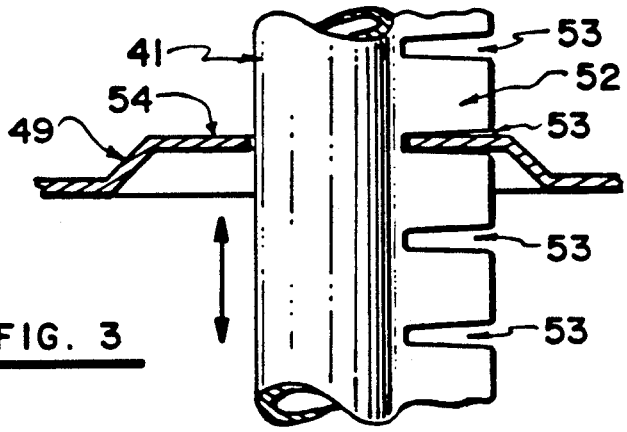
FIG. 3 is a cross sectional view along the lines of 3—3 of FIG. 2.

The pipe 41 is mounted for sliding movement within a support element 49 formed in an upper plate 50 of the housing 28. The pipe 41 is mounted within the element 49 so as to be maintained at a predetermined angle and so that it can slide within the support element 49 directly along the longitudinal axis of the pipe 41. For this purpose the support element 49 may include a sleeve section (not shown) which confines the pipe and prevents any possibility of twisting of the axis. In addition the support of element 49 allows the pipe 41 to rotate around its axis. As best shown in FIGS. 2 and 3, the support element 49 includes a slot 51 and the pipe 41 includes a longitudinal fin 52 which slides along this slot 51. The fin 52 has a plurality of recesses 53 cut into the fin parallel to an upper plate 54 of the support element 49. The recesses 53 thus act as guides or locating points so that the pipe can only be rotated about its axis when one of the recesses 53 is aligned with the top plate 54. The spacing of the recesses 53 is arranged to be equal to the spacing of the recesses within the bowl so that each recess 53 defines a location of the pipe so the lower most end thereof cooperates with a recess within the bowl when a recess within the fin is located relative to the plate 54

Figure 5:
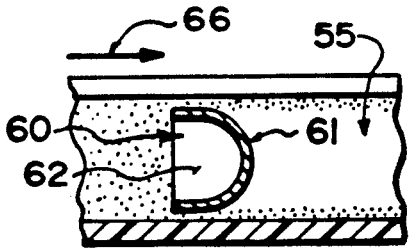
FIG. 5 is cross-section view along the line 5—5 of FIG. 4.
Figure 4:
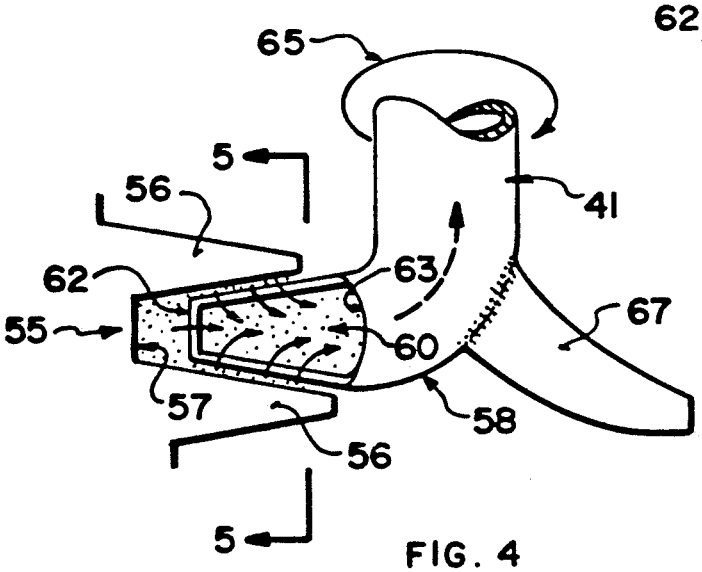
FIG. 4 is a side elevational view of a portion only of the apparatus of FIG. 1 and particularly that showing the details of the probe portion at the lower end of the extraction duct.

The lower end of the pipe 41 is best shown in FIGS. 4 and 5. In FIG. 4, one of the recesses is indicated generally at 55 and includes two side walls 56 defining therebetween the recess 55 which tapers toward a narrower base 57 from a mouth of the recess. Generally the whole of the recess is filled with the material which has been collected thus forming a concentrate of the heavy metal for collection.

At the lower end of the pipe 41 is provided a probe portion 58 which extends outwardly to one side of the pipe substantially at right angles.

As best shown in FIG. 1, the angle of the pipe is arranged to be directly parallel to the peripheral wall 12 of the bowl so that the pipe follows the line of the recesses and remains at a constant spacing from the mouth of the recess and from the base of the recess regardless of whether it is cooperating with the top recess or the bottom recess depending upon each longitudinal position.

Thus the probe portion 58 lies at a slight angle different from 90°. The probe portion is substantially D-shaped in cross section as best shown in FIG. 5 with the straight side of the D forming an open mouth 60 and with the curved side of the D indicated at 61 being formed by a wall curved around the rear of the probe so the probe forms a scoop. In addition, the probe tapers from a width substantially equal to the width of the pipe 41 at the inner end to a flat base 62 at the outer most end. The angle of taper is substantially equal to the taper of the side walls 56 of the groove of recess 55. An edge of the mouth 60 is indicated at 63 so that from that edge the probe is continuous into the pipe 41 and fully surrounds the material so the material entering the mouth tends to flow into the pipe 41 forced into that position by the widening effect of the probe portion from the point where the material enters toward the bottom of the pipe 41.

As previously stated, the pipe 41 is rotatable about its axis as indicated by the arrow 65. In a withdrawing action for each of the recesses, therefore, the pipe is moved axially until one of the recess 53 is aligned with the plate 54 thus locating the probe portion relative to a respective one of the recesses of the bowl. In this position only the pipe 41 can be rotated in the direction of the arrow 65 so that the scoop or mouth of the probe portion is rotated in the direction opposite to the direction of rotation of the bowl indicated at the arrow 66 to cause the mouth to rotate from a position spaced from the recess into the recess to take up the position shown in FIGS. 4 and 5 projecting into the recess but spaced from the base of recess. This causes the material in that part of the recess which is aligned with the mouth to enter into the mouth and be forced along the pipe 41. Thus a proportion of the material within the recess passes into the pipe 41 while part of the material remains within the recess for further processing after the pipe and probe portion are removed.

The lowermost one of the recesses 53 can act as a park arrangement by which the pipe can be withdrawn to a raised position away from the bowl so it does not in any way interfere with the further processing of the materials during a pre-determined period of operation of the device in which the withdrawal device is maintained inoperative.

On the lowermost part of the pipe 41 at a position adjacent the probe 53 but at 180° spacing therefrom is a tine member 67. In some embodiments of device of this type it is difficult for the probe to reach into the lowermost ring or recess and in this case the tine member 67 is used instead of the probe simply to remove some of the material from the lower most ring which material then passes over the further recesses and is separated with the heavy metals being collected in the further recesses. The tine member 67 simply comprises a flat blade or projecting tine which can be slightly scooped to cause the material to be ejected from the lower most recess as the bowl rotates relative to the stationary tine member.

In operation, after a significant period of processing at which time the recesses are at or approaching situation where the efficiency of separation will deteriorate, the discharge arrangement is operated. The pipe is thus brought into operation and moved to a position in which the scoop or probe member can be inserted into the first or uppermost one of the recesses. The pipe is then rotated so that the scoop enters the recess allowing the material to be forced into the lower end of the pipe. At the same time as the pipe is rotated for the scoop to enter the recess, the valve 43 is operated to generate a pulse of vacuum which sucks the withdrawn material from the lower end of the pipe along the pipe and then downwardly along the hose section which is inclined downwardly toward the tank 45. The valve 43 is then closed and the pipe 41 rotated rearwardly to remove the probe from the first recess. In operation with the bowl rotating at a rate of approximately four times per second, the pipe is rotated for a period of approximately 0.5 seconds so that at least two full rotations of the bowl occur before the probe is withdrawn from the recess. This acts to extract all of the collected materials within the area of the mouth together with some further materials as further materials are fed into the recess behind the probe and as the materials remaining in the recess tend to collapse into the area of the open mouth behind the curved rear wall of the probe.

The process is then repeated for the second recess etc. down to the lowermost recess where it necessary due to the particular design of the bowl, the tine 67 can be actuated.

As the highest percentage of collection occurs at the lower rings or recesses, starting at the upper recess causes the least loss due to disturbance of the materials since any disturbance of materials in the lower recesses causes those materials to be further separated as they pass over the recesses remaining above the recess concerned before the material is discharged from the open mouth.

In practice the amount of material separated is generally less than one half of the material which would be collected in a conventional wash down process of the same bowl. In some examples this amount may be of the order of 20% of the total but this has been found to enable the device to operate effectively and for the withdrawal of the concentrate to be effective due to the fluidization and disturbance of the material in the recess which occurs despite the fact that each recess is not scraped fully clean during the withdrawal.

A conventional plug generally indicated at 70 remains in the bottom of the bowl for a conventional washdown should this become necessary after an extended period of operation or if the bowl is halted for maintenance or other purposes.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of centrifugally separating intermixed materials of different specific gravities comprising providing a centrifuge bowl having a base and a peripheral wall surrounding an axis passing through the base and generally upstanding from the base to an open mouth, defining on the bowl a plurality of axially spaced inwardly projecting peripherally extending ring members defined on an inner surface of the peripheral wall so as to provide a plurality of peripherally extending recesses each between one ring member and a next adjacent ring member, the recesses being arranged as a series of the recesses in axially spaced location including an uppermost recess, a plurality of intermediate recesses and a lowermost recess, rotating the bowl about the axis, feeding materials into the bowl such that during rotation of the bowl the materials flow over the peripheral wall with discarded materials discharging from the open mouth and retained material being collected on the peripheral wall within each of the recesses as a concentrate, fluidizing the material in the recesses by injection of fluid through the peripheral wall into each recess, providing a probe member, supporting the probe member on a support element extending into the bowl from a location exteriorly of the bowl, actuating the support element so as to move the probe member in a substantially radial direction of the bowl to a position temporarily inserted into each recess in turn to a location therein spaced from the peripheral wall so as to cause a part only of the material within said each recess to be extracted from said each recess, collecting the extracted material, actuating the support element so as to move the probe member in a substantially radial direction out of said each recess, the support element being held so as to prevent movement of said probe member in said substantially radial direction except when the probe member is radially aligned with said each recess in turn, said support element being moved such that the probe member enters each recess in turn from the uppermost recess through the plurality of intermediate recesses to the lowermost recess.

2. A method according to claim 1 wherein less than one half of the material within the recess is withdrawn into the probe portion.

3. A method according to claim 1 including providing a mouth on the probe member arranged on a side of the probe member facing tangentially around the peripheral wall of the bowl and facing toward the material on the peripheral wall moving toward the probe member.

4. A method according to claim 1 including providing a probe member which has an upper and a lower surface tapered in a radially outward direction.

* * * * *